US012546312B2

(12) United States Patent
Wiessmann

(10) Patent No.: US 12,546,312 B2
(45) Date of Patent: Feb. 10, 2026

(54) OIL PUMP FOR A MOTOR VEHICLE

(71) Applicant: Brose Fahrzeugteile SE & Co. Kommanditgesellschaft, Würzburg, Würzburg (DE)

(72) Inventor: Nico Wiessmann, Würzburg (DE)

(73) Assignee: Brose Fahrzeugteile SE & Co. Kommanditgesellschaft, Würzburg, Würzburg (DE)

( * ) Notice: Subject to any disclaimer, the term of this patent is extended or adjusted under 35 U.S.C. 154(b) by 0 days.

(21) Appl. No.: 18/846,732

(22) PCT Filed: Mar. 13, 2023

(86) PCT No.: PCT/EP2023/056378
§ 371 (c)(1),
(2) Date: Oct. 1, 2024

(87) PCT Pub. No.: WO2023/174888
PCT Pub. Date: Sep. 21, 2023

(65) Prior Publication Data

US 2025/0092872 A1 Mar. 20, 2025

(30) Foreign Application Priority Data

Mar. 16, 2022 (DE) ..... 10 2022 202 619.5

(51) Int. Cl.
*F04C 2/10* (2006.01)
*F04C 2/08* (2006.01)
*F04C 15/00* (2006.01)

(52) U.S. Cl.
CPC ..... *F04C 2/102* (2013.01); *F04C 2/086* (2013.01); *F04C 15/0088* (2013.01);
(Continued)

(58) Field of Classification Search
CPC ..... F04C 2/102; F04C 2/086; F04C 15/0088; F04C 2210/206; F04C 2240/20;
(Continued)

(56) References Cited

U.S. PATENT DOCUMENTS 6,179,595 B1 1/2001 Buchmüller
10,012,220 B2 7/2018 Matz et al.
(Continued)

FOREIGN PATENT DOCUMENTS

DE 4345269 C2 10/1998
DE 19923851 A1 12/1999
(Continued)

*Primary Examiner* — Mary A Davis
(74) *Attorney, Agent, or Firm* — Laurence A. Greenberg; Werner H. Stemer; Ralph E. Locher

(57) ABSTRACT

An oil pump for a motor vehicle, in particular an electrically operated gear pump, contains a pump housing that is closed relative to an end side by a housing cover, a shaft which extends in a longitudinal direction and to which a pump wheel is secured. The shaft is mounted on a first bearing and on a second bearing on both sides of the pump wheel. A pressure chamber is formed on a pressure side, and a lubricant channel leads from the pressure chamber to the shaft in a region of the first bearing for the lubrication of the two bearings. Between the shaft and the pump wheel secured to the shaft, at least one longitudinal channel also leads along the pump wheel to the second bearing.

12 Claims, 2 Drawing Sheets

(52) U.S. Cl.
CPC .... *F04C 2210/206* (2013.01); *F04C 2240/20* (2013.01); *F04C 2240/30* (2013.01); *F04C 2240/40* (2013.01); *F04C 2240/50* (2013.01); *F04C 2240/56* (2013.01)

(58) Field of Classification Search
CPC ..... F04C 2240/30; F04C 2240/40; F04C 2240/50; F04C 2240/56
See application file for complete search history.

(56) References Cited

U.S. PATENT DOCUMENTS

| | | | | |
|---|---|---|---|---|
| 10,400,767 | B2 * | 9/2019 | Miyagawa | F04C 15/0088 |
| 2013/0294940 | A1 | 11/2013 | Matz et al. | |
| 2019/0301455 | A1 * | 10/2019 | Ehringer | F04C 2/086 |
| 2021/0324855 | A1 * | 10/2021 | Yokoi | F04C 2/102 |

FOREIGN PATENT DOCUMENTS

| | | | |
|---|---|---|---|
| DE | 202016107030 | U1 | 3/2018 |
| JP | 2014173587 | A | 9/2014 |
| WO | 2012066483 | A2 | 5/2012 |
| WO | 2022048364 | A1 | 4/2022 |

* cited by examiner

OIL PUMP FOR A MOTOR VEHICLE

FIELD AND BACKGROUND OF THE INVENTION

The invention relates to an oil pump for a motor vehicle, in particular an electrically driven pump.

For such oil pumps, so-called gerotor pumps are often used, the structure of which is known in principle and which have a rotor set having an inner rotor which is arranged on a shaft and which has external teeth and an outer rotor which has internal teeth. The shaft is in this instance often supported by a plain bearing. Adequate lubrication of the bearing is required for reliable operation.

JP 2014 173 587 A sets out a gerotor pump which has a pump housing having an end housing cover in which a suction channel and a pressure channel for the oil are formed. A rotor set having an inner rotor and an outer rotor is arranged in the pump housing. An electric motor for driving the shaft is arranged opposite the housing cover. The shaft is supported on a plain bearing in the pump housing at the side of the rotor set opposite the housing cover. In order to lubricate the plain bearing, there is formed in a state adjoining the rotor set in the pump housing a lubricant channel which extends in the direction toward the shaft and the bearing. In a state adjacent to the bearing, a shaft sealing ring is arranged in the direction toward the electric motor.

A two-sided bearing is advantageous for a stable bearing of the shaft. However, this requires additional measures for lubrication of the two bearings. This generally leads to complex lubricant systems which may have a negative influence on the efficiency of the pump.

SUMMARY OF THE INVENTION

Based on this, an object of the invention is to provide an oil pump, in particular an electromotively driven oil pump for a motor vehicle having a shaft which is supported at two sides, wherein the two bearings are reliably lubricated with little complexity during operation, wherein the degree of efficiency of the oil pump is influenced as little as possible.

This object is achieved according to the invention by an oil pump for a motor vehicle, in particular an electrically driven oil pump, particularly a gear pump and in particular a gerotor pump. The pump has a pump housing which is closed in the direction toward an end face by a housing cover. A pump unit for conveying the oil from the intake side to a pressure side is arranged in the pump housing. The pump unit has a shaft which extends in a longitudinal direction and to which a pump wheel, specifically a gear, is secured. The shaft is supported at both sides of the pump wheel on a first bearing and on a second bearing. At the pressure side, a pressure chamber is formed, wherein in order to lubricate the two bearings from the pressure chamber a lubricant channel is guided to the shaft in the region of the first bearing so that during operation the first bearing is supplied with oil via the lubricant channel in order to lubricate the first bearing. Furthermore, between the shaft and the pump wheel which is secured thereto at least one longitudinal channel is guided along the pump wheel in the direction toward the second bearing so that via the longitudinal channel during operation the oil is also guided to the second bearing in order to lubricate it with the oil.

A particular advantage of this lubricant system for lubricating the two bearings can be seen in that two separate lubricant supply systems for lubricating the two bearings are not required. Instead, as a result of the configuration of the longitudinal channel a simple and non-complex lubricant supply of the second bearing is also reliably achieved.

As a result of the two-sided bearing, on the one hand, this embodiment has the advantage that bearing forces are distributed over the two bearings. It is thereby possible in comparison with an only one-sided bearing to use a thinner shaft and/or the axial length of the bearings can be shortened in comparison with a single-sided bearing. On the whole, a more compact construction type can thereby be achieved, in particular the pump housing and the shaft, as a result of a selective division of the overall length over the pump housing and the housing cover in which the two bearings are preferably formed, can be configured to be shorter. On the whole, material and axial structural space are thereby saved.

Since, in the solution proposed in this instance, the lubricant for the bearings is not supplied via two separate lubricant systems, the oil which is required to lubricate the bearings and which virtually forms a leakage oil is reduced in comparison with two separate lubricant systems. This means that the leakage oil required to lubricate the two bearings is low and consequently the degree of efficiency of the pump is influenced only to a small extent.

Where in this instance an oil pump is mentioned, a lubricant pump for conveying a lubricant is generally intended to be understood.

In a preferred embodiment, a plurality of longitudinal channels are formed around the shaft. In this instance, these are in particular arranged in a state distributed in a uniform manner around the circumference. For example, two to six and in particular, for example, four longitudinal channels are formed. They typically extend parallel with the longitudinal direction. As a result of the plurality of longitudinal channels, a reliable supply of the second bearing is also ensured. At the same time, the free flow cross sections of the individual longitudinal channels can be reduced in comparison with only one longitudinal channel, which on the whole benefits the stability.

In a preferred embodiment, the at least one longitudinal channel and preferably all the longitudinal channels are in each case in the form of a groove in the pump wheel. The respective groove is in this instance introduced at the inner circumference of the pump wheel and is open in the direction toward the shaft. The pump wheel is generally preferably in the form of a gear and specifically an inner rotor with external teeth. Preferably, the groove is in this instance fitted at a circumferential position at which a respective (outer) tooth of the gear is formed. In particular, the number of longitudinal channels corresponds to the teeth and all the longitudinal channels are in each case arranged in a circumferential region which is reinforced by a respective tooth. The stability of the pump wheel is not thereby influenced or is influenced only insignificantly.

With such oil pumps, the oil, which is intended to be pumped, of the pump unit which is arranged in the pump housing is regularly supplied via the housing cover and discharged again. On the housing cover, therefore, both a suction connection, for example, a suction nozzle, and a pressure connection, for example, a pressure nozzle, are typically formed. The housing cover has at the inner side thereof the pressure chamber into which the pumped oil flows from the pump unit at the pressure side during operation. This pressure chamber is in this instance typically in the form of a recess in the housing cover which is in particular configured in the manner of an annular segment and, for example, kidney-shaped. The lubricant is now guided from this pressure chamber which is formed in the housing cover in a radial direction toward the shaft.

In this instance, the lubricant channel is in particular in the form of a groove in the housing cover. This groove is in turn configured to be open in the direction toward the pump wheel, that is to say, generally in the direction toward the pump unit.

The housing cover itself preferably has the first bearing location and consequently the first bearing. To this end, a bearing eye is formed in the housing cover in order to receive and support the shaft.

In an advantageous further development, in the region of the second bearing a chamber is formed in order to collect the oil which is supplied via the at least one longitudinal channel. This chamber is open in the direction toward the shaft so that a lubrication and supply of the second bearing is carried out via this chamber.

This chamber is in this instance preferably in the form of a recess in the pump housing. Generally, the pump housing forms a second bearing location and consequently the second bearing for the shaft. To this end, the pump housing has in a state adjacent to the pump unit and consequently adjacent to the pump wheel an end wall which is configured to support the shaft and for this purpose preferably again has a bearing eye. The chamber is now virtually in the form of a type of recess in the edge of this bearing eye and opens into the bearing eye. In a preferred embodiment, only a single such chamber is formed. In this instance, the chamber extends only over a limited angular range. This is, for example, less than 90°, preferably less than 20° and extends, for example, only over an angular range of a few degrees (less than) 10°.

In a preferred embodiment, the two bearings are generally in the form of plain bearings. The shaft is in this instance supported in the bearing eyes which have already been mentioned, wherein one bearing eye is formed inside the housing cover and the other bearing eye is formed in the pump housing, specifically in the above-described end wall. For the best possible support, the bearing eyes can where necessary be prepared in a suitable manner, for example, provided with a coating or formed by a separate bearing bush.

The oil pump is in particular an electromotively driven pump which has an electric motor in order to drive the shaft. The second bearing is orientated in the direction toward the electric motor.

In a preferred embodiment, it is configured in such a manner that during operation a leakage flow of the oil used to lubricate the bearing reaches the electric motor and cools it during operation. The leakage oil for lubricating the bearing is therefore also used in addition for cooling the electric motor. In order to achieve this, therefore, in the region of the second bearing (additional) sealing measures, for example, a shaft sealing ring, for sealing the shaft in the direction toward the electric motor are deliberately dispensed with.

In a preferred embodiment, the pump wheel is generally a gear and the oil pump is therefore a gear pump.

In a preferred embodiment, the oil pump is a gerotor pump in which the pump unit has at least one gear set/pump wheel set having an externally toothed inner rotor as the pump wheel and an externally toothed outer rotor.

An exemplary embodiment of the invention will now be explained in greater detail with reference to the figures.

DETAILED DESCRIPTION OF THE INVENTION

Figure 1:
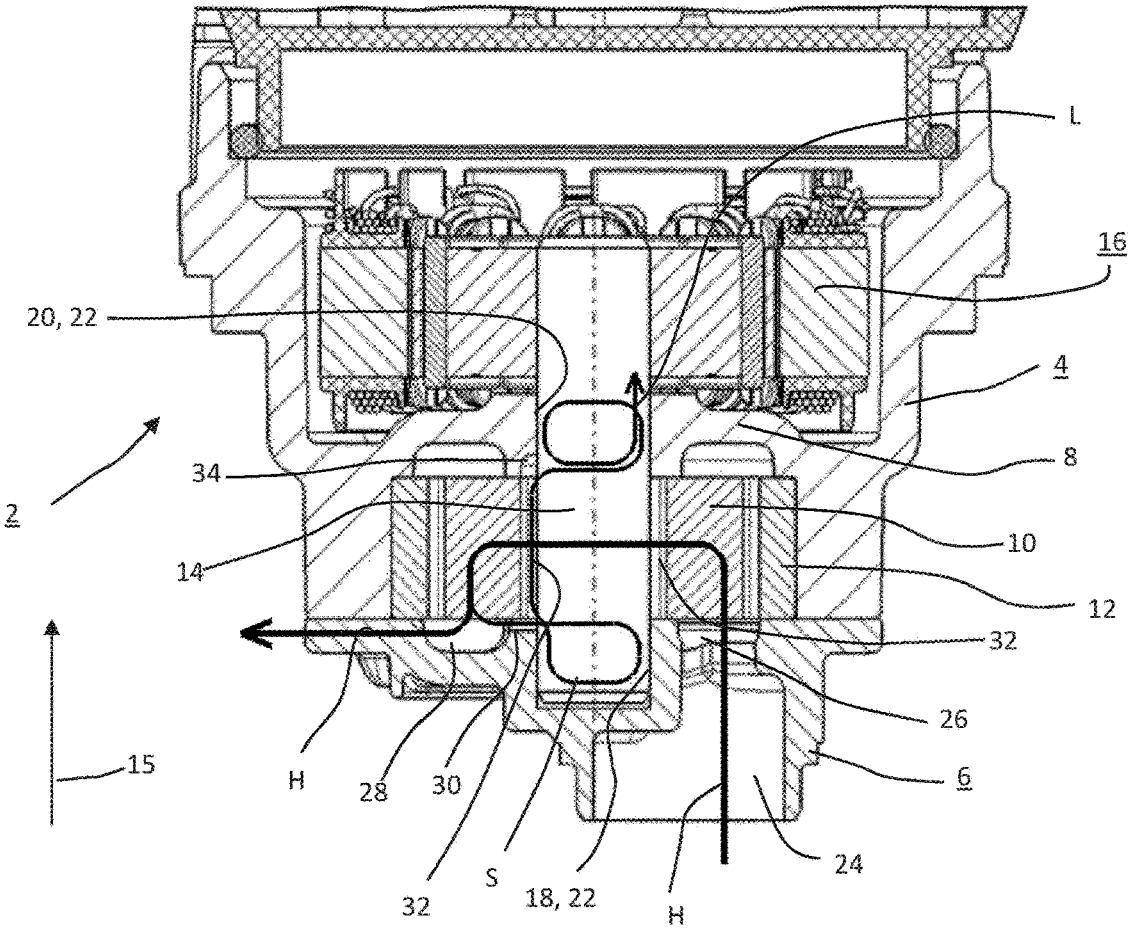
FIG. 1 shows a sectioned illustration through an oil pump which is in the form of an electromotively driven gerotor pump.

The oil pump 2 illustrated in FIG. 1 is in the form of an electric gerotor pump. It has a pump housing 4 which is closed in the direction toward an end face by a housing cover 6. The pump housing 4 has an end wall 8 which is arranged at the inner side as an intermediate wall, wherein between this wall and the housing cover 6 a pump unit for conveying oil is arranged. In a gerotor pump—as is the case in this instance—for this purpose a pump wheel set comprising an externally toothed inner rotor 10 and an internally toothed outer rotor 12 is formed as a pump unit. The inner rotor 10 is connected to a shaft 14 in a rotationally secure manner and is driven thereby. The inner rotor 10 thus forms a pump wheel. The shaft 14 extends from the housing cover 6 in a longitudinal direction 15.

The shaft 14 is driven during operation by an electric motor 16 which when viewed in the longitudinal direction 15 is arranged in a housing portion of the pump housing 4 following the end wall 8.

The shaft 14 is supported in a first bearing 18, that is to say, in a bearing eye 22 of the housing cover 6, and in a second bearing 20, that is to say, in a bearing eye 22 of the end wall 8. The two bearings 18, 20 are in each case in the form of a plain bearing. The shaft 14 extends through this end wall 8 and forms the output shaft of the electric motor 14.

The housing cover 6 and the end wall 8 enclose between them a pump space, within which oil is pumped by means of the pump unit. At a suction side the oil is drawn in via a suction nozzle 24 which is formed on the housing cover 6 and at a pressure side the oil is discharged via a typically radial pressure channel or pressure nozzle which cannot be seen in this instance. It is preferably also formed in the housing cover 6.

Figure 2:
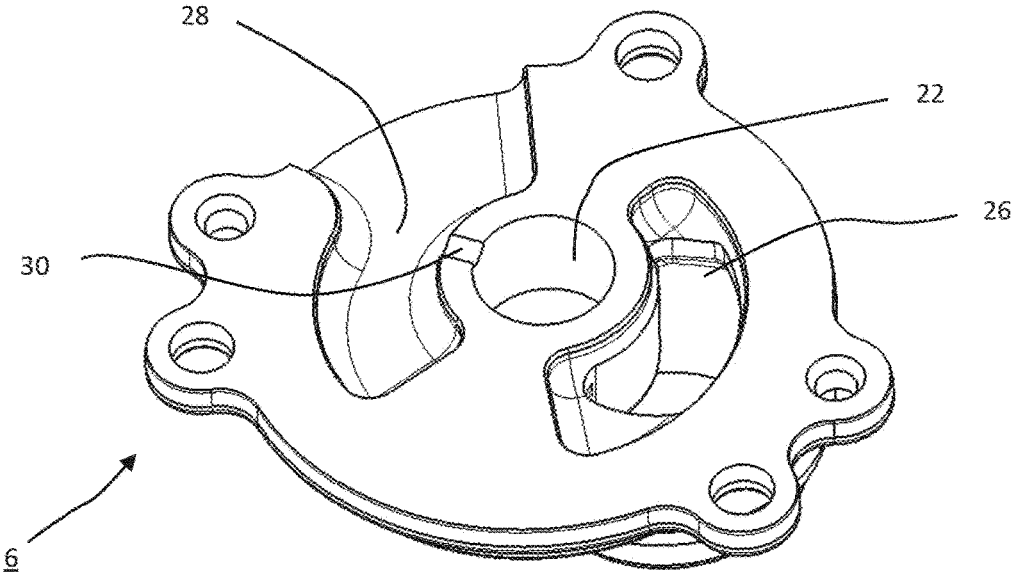
FIG. 2 shows a perspective illustration of an inner side of a housing cover.

The housing cover 6 has at the inner side of the front delimitation wall an inlet chamber 26 and a pressure chamber 28. They extend in each case in a circumferential direction in the manner of an annular segment (cf. in this regard in particular also FIG. 2).

Starting from the pressure chamber 28 a lubricant channel 30 extends and connects the pressure chamber 28 in technical flow terms to the bearing eye 22. The lubricant channel 30 therefore extends in the direction of and as far as the shaft 14. It is particularly in the form of a groove which extends in a radial direction within the housing cover 6.

Via this lubricant channel 30, during operation some of the pressurized oil acting virtually as a lubricant flow S from the pressure chamber 28 therefore reaches the shaft and consequently the first bearing 18 in order to lubricate it. This lubricant flow S passes counter to the longitudinal direction L through the bearing 18 in order to lubricate it and is then returned again in the direction toward the pressure chamber 28.

The main flow M of the conveyed oil is discharged via the pressure channel of the housing cover 6.

In order to also supply the second bearing 20 with the oil as a lubricant in the exemplary embodiment there are further formed a plurality of longitudinal channels 32 which extend along the shaft 14, over the entire length of the inner rotor 10 so that the oil can reach the opposite bearing location and consequently the second bearing 20 in order to lubricate it. This oil flow passes through the second bearing 20 and reaches the electric motor 16 and cools it. This flow therefore forms a leakage flow L. It is subsequently collected and supplied to the pump circuit again in an appropriate manner.

The various flows, that is to say, the main flow M, the lubricant flow S and the leakage flow L are indicated in FIG. 1 by arrows with different line thicknesses.

It should be emphasized that via the lubricant channel 30 the lubricant for both bearings 18, 20 is guided together.

Figure 4:
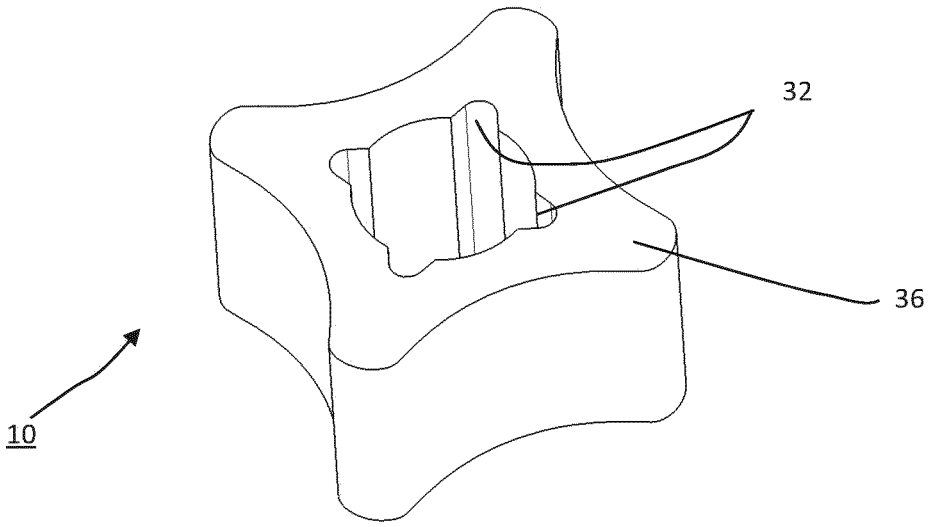
FIG. 4 shows a perspective view of an inner rotor.

The longitudinal channels 32 are in the form of longitudinal grooves on the inner rotor 10 and are open in the direction toward the shaft 14, as can be seen in particular in FIG. 4. In the exemplary embodiment, 4 longitudinal grooves are formed. Preferably, a respective longitudinal groove is in each case formed at the circumferential position of an (outer) tooth 36 of the inner rotor 10. The stability is therefore influenced as little as possible.

On the end wall 8 there is further formed directly in the region of the shaft a chamber 34 in the manner of a collection chamber in which the oil supplied via the longitudinal channels 32 can accumulate and is then drawn along the shaft 14 in order to lubricate the second bearing 20 and passes through it in the direction toward the electric motor 16.

Figure 3:
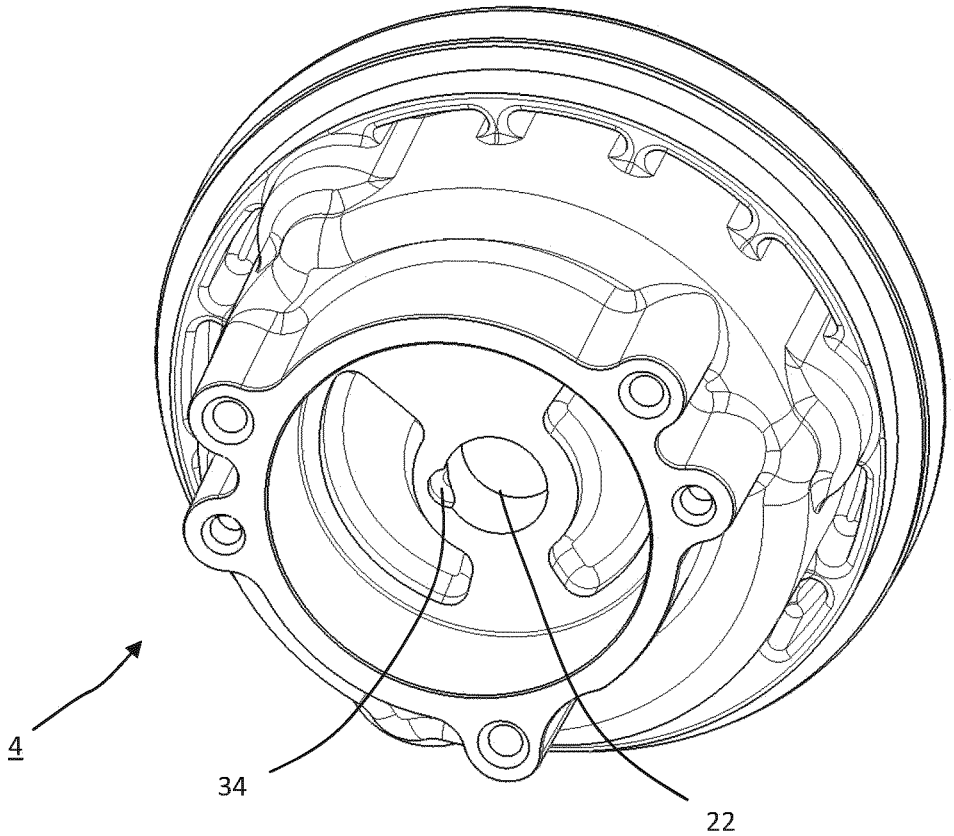
FIG. 3 shows a perspective illustration of a pump housing.

As can be seen in particular in the view of FIG. 3, this chamber 34 is configured in the manner of a recess which adjoins the bearing eye 22. It can further be seen in FIG. 3 and also FIG. 1 that there are formed in the end wall 8 further annular-segment-like recesses which virtually form extensions of the pump space at the suction side and pressure side.

During operation of the oil pump 2, the shaft 14 is driven by means of the electric motor 16 and rotates about a central shaft axis. In this instance, the inner rotor 10 is also driven and via the gear set (pump unit) the oil is drawn in at the suction side and discharged as the main flow H via the pressure side.

Some of the oil is guided as lubricant flow S via the lubricant channel 30 to the first bearing 18, passes through it counter to the longitudinal direction 15 and is supplied again to the main flow M. At the same time, some of the oil is also conveyed initially as a leakage flow L via the lubricant channel 30 in the direction toward the shaft 14 and from there via the longitudinal channels 32 and in particular also via the chamber 34 finally reaches the second bearing 20, lubricates it and passes through it to the electric motor 16. The leakage flow L is then supplied again to the oil guided in the circuit in a manner which is not illustrated in greater detail.

The oil pump 2 illustrated in this instance in the installed state is preferably arranged inside a motor vehicle and serves to supply one or more components of the motor vehicle with oil, in particular for lubrication and consequently to reduce the friction of moving components of the motor vehicle. Alternatively or additionally, the oil is also used for cooling. The components are, for example, gearboxes. Generally, the oil is guided in the circuit and pumped out of an oil store, specifically a dry sump, into an oil tank and/or out of this oil tank to the components and collected again.

The invention is not limited to the exemplary embodiment described above. Instead, other variants of the invention can also be derived therefrom by the person skilled in the art without departing from the subject-matter of the invention. In particular all the individual features described in connection with the exemplary embodiment can also be combined with each other in another manner without departing from the subject-matter of the invention.

LIST OF REFERENCE NUMERALS

2 Oil pump
4 Pump housing
6 Housing cover
8 End wall
10 Inner rotor
12 Outer rotor
14 Shaft
15 Longitudinal direction
16 Electric motor
18 First bearing
20 Second bearing
22 Bearing eye
24 Suction nozzle
26 Inlet chamber
28 Pressure chamber
30 Lubricant channel
32 Longitudinal channel
34 Chamber
36 Tooth
M Main flow
S Lubricant flow
L Leakage flow

The invention claimed is:

1. An oil pump for a motor vehicle, the oil pump comprising:

a housing cover having a pressure chamber and a lubricant channel formed therein;

a pump housing being closed in a direction toward an end face by said housing cover;

a pump wheel having at least one longitudinal channel formed therein;

bearings including a first bearing and a second bearing; and a shaft extending in a longitudinal direction and to which said pump wheel is secured, wherein said shaft is supported at both sides of said pump wheel on said first bearing and on said second bearing, wherein at a pressure side said pressure chamber is formed, and in order to lubricate said bearings oil from said pressure chamber is guided thru said lubricant channel to said shaft in a region of said first bearing, wherein said at least one longitudinal channel is between said shaft and said pump wheel which is secured to said shaft, oil is further guided along said at least one longitudinal channel in said pump wheel up to said second bearing.

2. The oil pump according to claim 1, wherein said at least one longitudinal channel is one of a plurality of longitudinal channels formed in said pump wheel around said shaft.

3. The oil pump according to claim 1, wherein said at least one longitudinal channel is in a form of a groove in said pump wheel.

4. The oil pump according to claim 1, wherein said pump wheel is in a form of a gear and said at least one longitudinal channel is disposed in a circumferential region of said pump wheel, said pump wheel further has a tooth.

5. The oil pump according to claim 1, wherein said pressure chamber is formed in said housing cover and said lubricant channel is formed in a radial direction toward said shaft.

6. The oil pump according to claim 1, wherein said lubricant channel is in a form of a groove in said housing cover.

7. The oil pump according to claim 1, wherein in a region of said second bearing, said pump housing has a further chamber formed therein which is open in a direction toward said shaft to collect oil which is supplied via said at least one longitudinal channel.

8. The oil pump according to claim 7, wherein said further chamber is in a form of a recess formed in said pump housing.

9. The oil pump according to claim 1, wherein said bearings are in a form of plain bearings.

10. The oil pump according to claim 1, further comprising an electric motor driving said shaft and said second bearing is orientated in a direction toward said electric motor, wherein said second bearing is configured such that during operation a leakage flow of oil used to lubricate said second bearing reaches said electric motor and cools said electric motor.

11. The oil pump according to claim 1, wherein the oil pump is a gerotor pump having said pump wheel as an externally toothed inner rotor.

12. The oil pump according to claim 1, where the oil pump is an electrically driven gear pump.

* * * * *